US007481674B2

(12) United States Patent
Murakami et al.

(10) Patent No.: US 7,481,674 B2
(45) Date of Patent: Jan. 27, 2009

(54) ELECTRICAL CONNECTOR

(75) Inventors: Takao Murakami, Shizuoka (JP); Seiji Kozono, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 31 days.

(21) Appl. No.: 10/581,195

(22) PCT Filed: Dec. 24, 2004

(86) PCT No.: PCT/JP2004/019350

§ 371 (c)(1),
(2), (4) Date: Jun. 1, 2006

(87) PCT Pub. No.: WO2005/064754

PCT Pub. Date: Jul. 14, 2005

(65) Prior Publication Data

US 2007/0184708 A1 Aug. 9, 2007

(30) Foreign Application Priority Data

Dec. 26, 2003 (JP) ..... 2003-434799

(51) Int. Cl.
*H01R 13/40* (2006.01)

(52) U.S. Cl. ..... 439/587

(58) Field of Classification Search ..... 439/587, 439/588, 589, 274, 275
See application file for complete search history.

(56) References Cited

U.S. PATENT DOCUMENTS 6,244,898 B1 6/2001 Suzuki
6,443,764 B2 * 9/2002 Makita ..... 439/587
2001/0009823 A1 * 7/2001 Suzuki ..... 439/587
2001/0023149 A1 * 9/2001 Murayama ..... 439/587
2001/0024907 A1 * 9/2001 Murakami et al. ..... 439/587
2002/0002001 A1 * 1/2002 Fukamachi ..... 439/587
2002/0115345 A1 * 8/2002 Nakamura et al. ..... 439/587
2002/0127912 A1 * 9/2002 Hamai et al. ..... 439/587
2003/0077939 A1 * 4/2003 Fukuda ..... 439/587

FOREIGN PATENT DOCUMENTS

JP 2-46383 3/1990
JP 10-172649 6/1998
JP 10-294157 11/1998
JP 2001-68208 3/2001
JP 2002-198127 7/2002

* cited by examiner

*Primary Examiner*—T C Patel
*Assistant Examiner*—Vladimir Imas
(74) *Attorney, Agent, or Firm*—Kratz, Quintos & Hanson, LLP

(57) ABSTRACT

The invention provides a connector having a pair of first and second connector housings for preventing looseness between the connector housings in lateral and longitudinal directions of the connector, surely eliminating frictional wear of male and female terminals in the connector housings. The connector can reliably resist to an external vibration force. A male connector housing 13 is resiliently urged by a waterproof packing 32 toward a female connector housing 36. The male connector housing 13 has an inner housing 25 formed with a plurality of looseness prohibiting projections 30. The looseness prohibiting projection 30 has a tapered surface 30*a*. An inner surface of a peripheral wall 39 of the female connector housing 36 is formed with a tapered surface 41 engaged with the tapered surface 30*a* on complete mating of the connector housings 13, 36. The waterproof packing 32 is closely sandwiched between the an outer surface of a peripheral wall 28 of the inner housing 25 and an inner surface of a peripheral wall 39 of the female connector housing 36.

2 Claims, 7 Drawing Sheets

ELECTRICAL CONNECTOR

FIELD OF THE INVENTION

The present invention relates to an electrical connector having a pair of connector housings which prevent looseness induced by vibration between the housings during operation of a motor vehicle to ensure electrical connection between male and female terminals in the connector housings.

BACKGROUND ART

A motor vehicle is arranged with wiring harnesses for transmitting electrical power and signals for various types of electronic instruments. The wiring harnesses have various types of connectors. For example, FIGS. 7 and 8 show one of such electrical connectors disclosed in Japanese Patent Application Laid-open No. 2002-198127 (in FIGS. 4, 6, and Page 3 to 4 in the document). The connector is designated by numeral 61.

The connector 61 shown in FIGS. 7 and 8 has a first connector housing 63 accommodating a receptacle terminal 62 and a second connector housing 65 accommodating a male terminal 70. The first connector housing 63 has a male inner housing 64 and an outer hood 66 defining a rectangular shell. The inner housing 64 accommodates the receptacle terminal 62 and is received in the hood 66. The receptacle terminal 62 is locked by a front holder 69. The front holder 69 is made of a synthetic resin and attached to the inner housing 64. The inner housing 64 has a base in which a waterproof packing 71 is mounted.

The second connector housing 65 is cylindrical and accommodates a pin terminal 70. The second connector housing 65 is inserted between the inner housing 64 and the hood 66 on engagement of the connector housings 63, 65 with each other.

The connector 61 has looseness preventing protrusions 67. The looseness preventing protrusions 67 are unitarily formed in an inner surface of the hood 66 or in an outer surface of the second connector housing 65. In the illustrated example, the looseness preventing protrusions 67 are provided on an inner surface of the hood 66 such that the looseness preventing protrusion 67 protrudes from the inner surface of the hood 66.

On engagement of the connector housings 63, 65 with each other, the looseness preventing protrusion 67 of the connector 61 is pressed by the inner surface of the hood 66 or the outer surface of the second connector housing 65. This prevents the connector housings 63, 65 from vibrating relative to each other in a direction perpendicular to the engagement direction of the connector housings 63, 65. The prevention of the relative vibration of the connector housings 63, 65 prohibits relative displacements of the terminals 62, 70. This prevents fretting wear of contact pieces of the terminals 62, 70. Thus, the connector 61 is improved to provide reliable electrical connection of the terminals 62, 70.

SUMMARY OF THE INVENTION

Object of the Present Invention

The connector 61 can resist against the vibration of the connector housings 63, 65 in a direction perpendicular to the engagement direction of the connector housings 63, 65. However, it is difficult to resist against vibration of the connector housings 63, 65 in a direction along the engagement direction of the connector housings 63, 65. The looseness preventing protrusion 67 is unitarily formed in the inner surface of the hood 66 or in the outer surface of the 65. Note that the connector mating direction makes the connector housings 63, 65 come toward each other.

Thus, the connector housings 63, 65 of the connector 61 displace relative to each other in the mating direction due to external vibrations, so that the terminals 62, 70 also displace relative to each other along the mating direction. Accordingly, the terminals 62, 70 of the connector 61 suffer fretting wear in contact pieces of them, deceasing electrical connection reliability of the terminals 62, 70.

To prevent vibration-induced movements of the connector housings 63, 65 in the mating direction, it may be proposed that a ring-shaped looseness prohibiting member is provided between the connector housings 63, 65 to prohibit looseness both in the connector mating direction and in the direction perpendicular to the mating direction. However, the separate part looseness prohibiting member does not directly prevent looseness between the connector housings 63, 65 and causes insufficient resistance to vibration. Furthermore, the looseness prohibiting member has inconsistency in dimensions, causing an unreliable vibration resistance. Furthermore, an additional mating force is required due to a frictional force between the looseness prohibiting member and the connector housings 63, 65 on mating of the connector housings 63, 65 with each other.

In view of the aforementioned situation, an object of the invention is to provide a connector having a pair of first and second connector housings for preventing looseness between the connector housings in lateral and longitudinal directions of the connector, surely eliminating frictional wear of male and female terminals in the connector housings. The connector can reliably resist to an external vibration force.

For achieving the object, according to a first aspect to the present invention, an electrical connector has a first connector housing, and a second connector housing mating with the first connector housing, wherein a tapered surface is provided in each of the first and second connector housings, the tapered surfaces inclined in the mating direction of the first and second connector housings, the tapered surfaces engaged with each other on mating of the first and second connector housings.

In the configuration, the engagement of the tapered surfaces formed in the first and second connector housings prohibit looseness between the connector housings in the longitudinal and lateral directions of the connector housings.

The tapered surfaces can resist to frictional wear more than protrusions otherwise provided in an outer or inner surface of the connector housings.

According to a second aspect of the present invention, as mentioned above, each tapered surface is unitarily formed with each connector housing.

In this configuration, since the tapered surface is unitarily formed in the connector housing, requiring no additional parts.

According to a third aspect of the present invention as mentioned above, an electrical connector has a first connector housing, and a second connector housing mating with the first connector housing, wherein a tapered surface is provided in one of the first and second connector housings, the tapered surface inclined in the mating direction of the first and second connector housings, the tapered surface engaged with a surface of the other connector housing on mating of the first and second connector housings.

In the configuration, the engagement of the tapered surface formed in the one of connector housings against the surface of the other connector housing prohibits looseness between the connector housings in the longitudinal and lateral directions.

The tapered surfaces inclined toward the mating direction can resist to frictional wear more than protrusions otherwise provided in an outer or inner surface of the connector housings.

According to a fourth aspect of the present invention, as mentioned above, the tapered surface is unitarily formed with the one of connector housings.

In this configuration, the tapered surface is unitarily formed in the connector housing, requiring no additional parts.

Furthermore, since the tapered surface is unitarily formed in the connector housing, the tapered surface can be positioned correctly to the other connector housing.

According to a fifth aspect of the present invention, as mentioned above, the other connector housing has an inner housing formed with a looseness prohibiting protrusion, wherein the tapered surface of the one connector housing abuts against the looseness prohibiting protrusion on mating the first and second connector housings.

In the configuration, the engagement of the looseness prohibiting protrusion with the tapered surface on complete mating of the first and second connector housings prohibits looseness between the connector housings in the longitudinal and lateral directions. The looseness prohibiting protrusion can ride on the tapered surface and may be a rib, a step, or the like. There may be provided a plurality of the looseness prohibiting protrusions in a circumferential direction of the connector.

According to a sixth aspect of the present invention, as mentioned above, the looseness prohibiting protrusion has a tapered surface engaged with the tapered surface of the one connector housing.

This configuration makes the connectors surely engage with each other to prohibit looseness of the connectors in the longitudinal and lateral directions.

According to a seventh aspect of the present invention, as mentioned above the inner housing is movable in the connector mating direction and is urged toward the one connector housing by a resilient member.

In the configuration, the engagement process of the connector housings pushes the inner housing to move it from the one connector housing until it abuts against the resilient member to be supported by the resilient member. This absorbs dimensional errors between the connector housings, so that the looseness prohibiting protrusion (tapered surface) engages the other tapered surface with no gap. Furthermore, external vibrations are absorbed by the resilient member, decreasing vibration transmitted to the terminals.

Moreover, the displacement of the inner housing advantageously reduces the mating force of the connectors on engagement of the connector housings.

According to an eighth aspect of the present invention, as mentioned above the resilient member is a waterproof packing mounted in the other connector housing, the waterproof packing closely sandwiched between an outer surface of a peripheral wall of the inner housing and an inner surface of a peripheral wall of the one connector housing.

In the configuration, the axial compression of the waterproof packing prohibits looseness between the connector housings. The waterproof packing is compressed radially (thickness direction) between the inner housing and the one connector housing. This closes a gap between the inner housing and the first connector housing, preventing invasion of external water.

ADVANTAGEOUS EFFECTS OF THE PRESENT INVENTION

As described above, according to the invention, the engagement of the tapered surfaces formed in the first and second connector housings prohibits looseness between the connector housings in the longitudinal and lateral directions. This surely prevents frictional wear of the male and female terminals to improve electrical connection in reliability.

The tapered surfaces can resist to frictional wear even with aged deterioration, so that the connector housings are prevented from vibration relative to each other, allowing a reliable resistance to external vibrations.

According to the invention, since the tapered surface is unitarily formed in the connector housing, requiring no additional parts.

Furthermore, since the tapered surface is unitarily formed in the connector housing, the tapered surfaces can be positioned correctly relative to each other. Thus, the connector housings are prevented from vibration relative to each other, allowing a reliable resistance to vibrations.

According to the invention, the engagement of the tapered surface formed in the one of connector housings against the surface of the other connector housing prohibits looseness between the connector housings in the longitudinal and lateral directions. This surely prevents frictional wear of the male and female terminals to improve electrical connection in reliability.

The tapered surfaces can resist to frictional wear even with aged deterioration, so that the connector housings are prevented from vibration relative to each other, allowing a reliable resistance to vibrations.

According to the invention, since the tapered surface is unitarily formed in the connector housing, requiring no additional parts.

Furthermore, since each tapered surface is unitarily formed in the connector housing, the tapered surfaces can be positioned correctly to each other. Thus, the connector housings are prevented from vibration relative to each other, allowing a reliable resistance to vibrations.

According to the invention, the engagement of the looseness prohibiting protrusion with the tapered surface prohibits looseness between the connector housings in the longitudinal and lateral directions. This surely prevents frictional wear of the male and female terminals in the connector housings to improve electrical connection in reliability. The connector housings can engage with each other with a smaller mating force as compared with the provision of a resilient ring disposed between the connectors.

According to the invention, this configuration makes the tapered surfaces surely engage with each other on complete mating of the connectors to improve a resistance to external vibrations to enhance the advantageous effects of the claim 1 invention.

According to the invention, the inner housing abuts against the resilient member to be resiliently supported by the resilient member on complete mating of the connector housings. The tapered surface engages the other tapered surface with no gap, allowing a reliable resistance to external vibrations. This prevents looseness between the connector housings so that the terminals can surely resist frictional wear due to the looseness of the connector housings. Furthermore, external vibrations are absorbed by the resilient member, decreasing vibration transmitted to the terminals to improve the connector in a vibration resisting performance.

Furthermore, the connector housings easily mate with each other since the connector housings require a smaller mating force by the presence of the inner housing.

According to the invention, the waterproof packing can prevent looseness of the connector housings and keep watertightness, decreasing the number of parts as compared with a looseness prohibiting member and a waterproof member that are separately provided. This decreases the connector in size and in manufacturing cost.

BRIEF DESCRIPTION OF THE ACCOMPANIED DRAWINGS

REFERENCE NUMERALS

Figure 1:
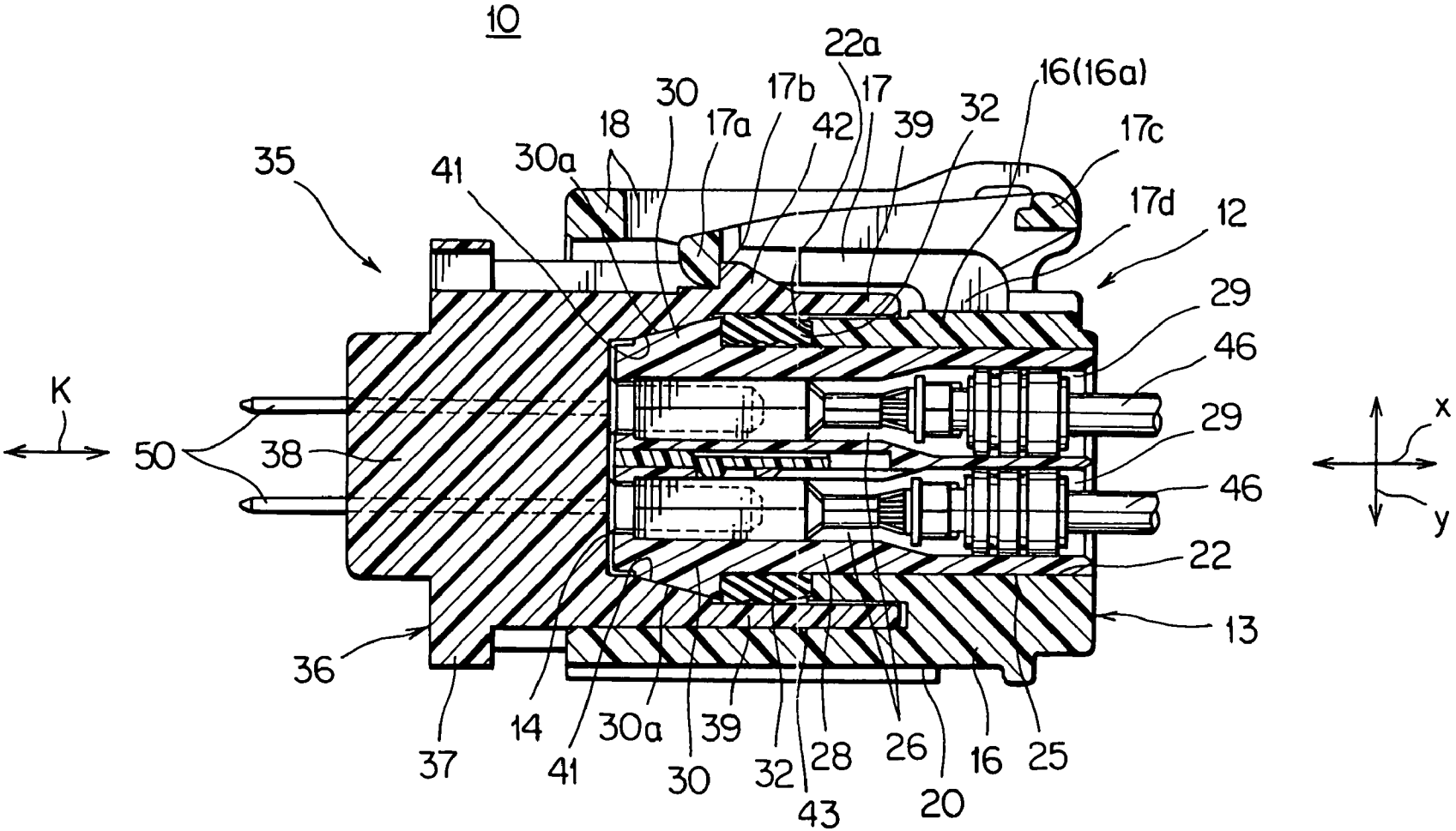
FIG. 1 is a sectional view showing an embodiment of an electrical connector according to the present invention.
Figure 2:
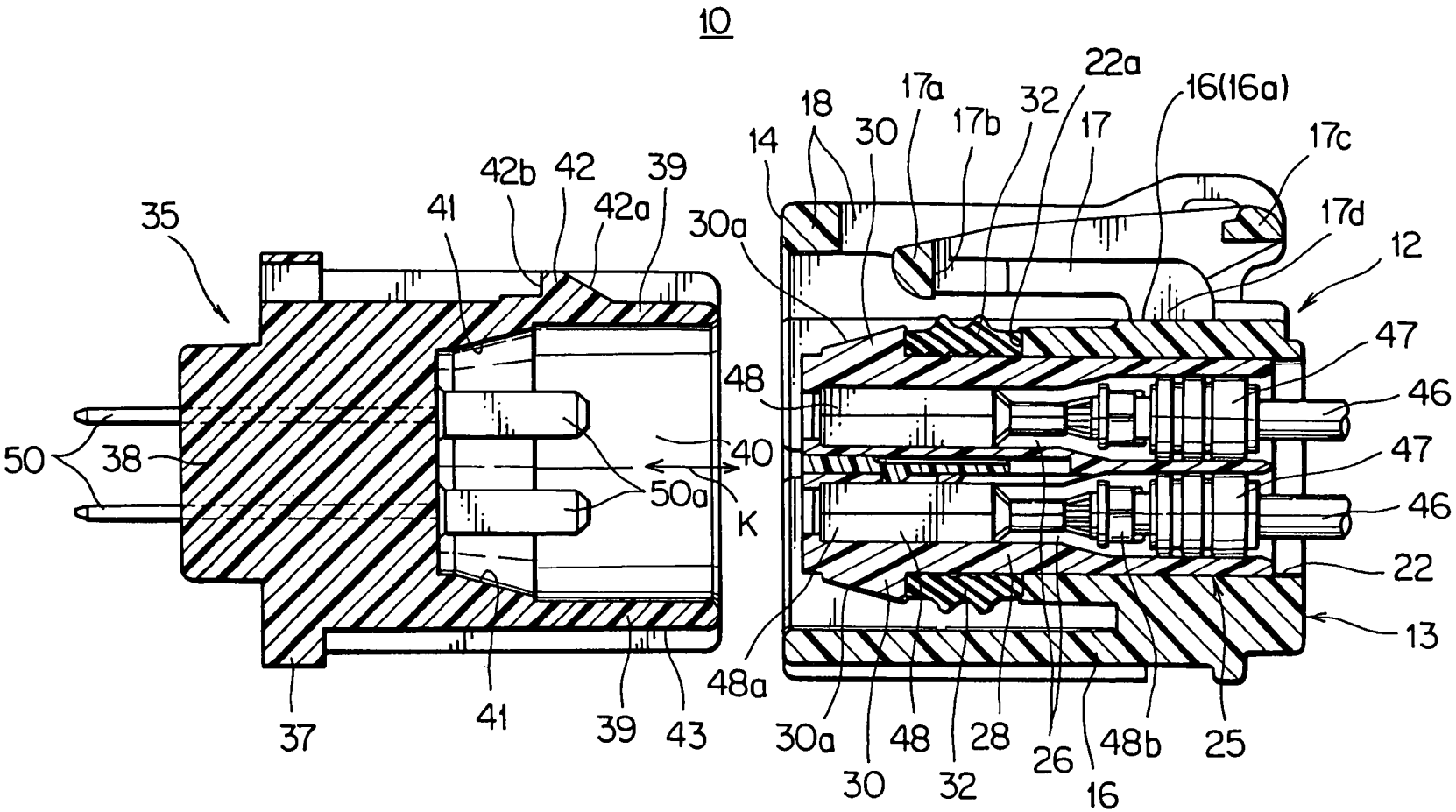
FIG. 2 is a sectional view showing a state where the connector of FIG. 1 is before mating of its housings.
Figure 3:
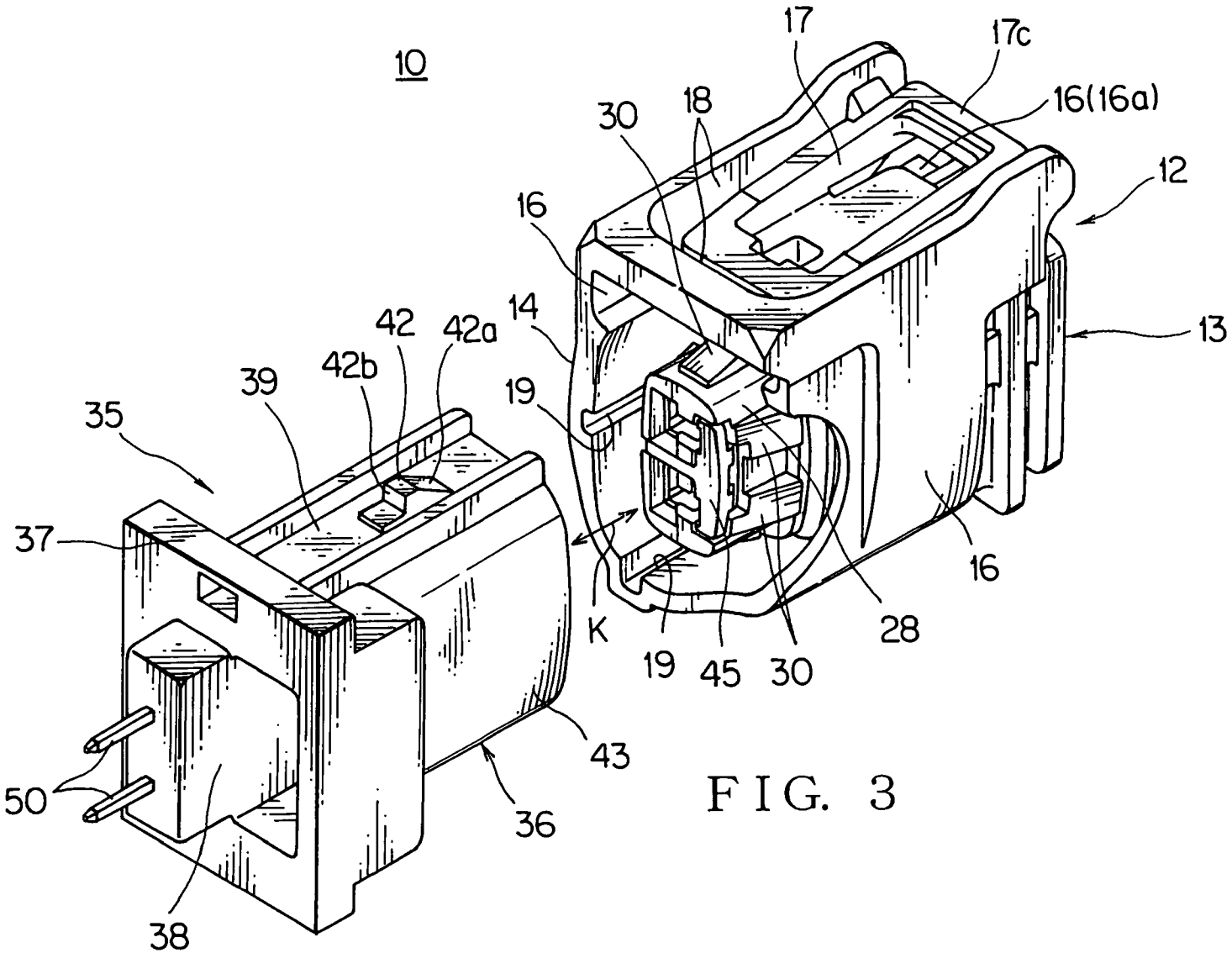
FIG. 3 is a perspective view showing the connector of FIG. 2.
Figure 4:
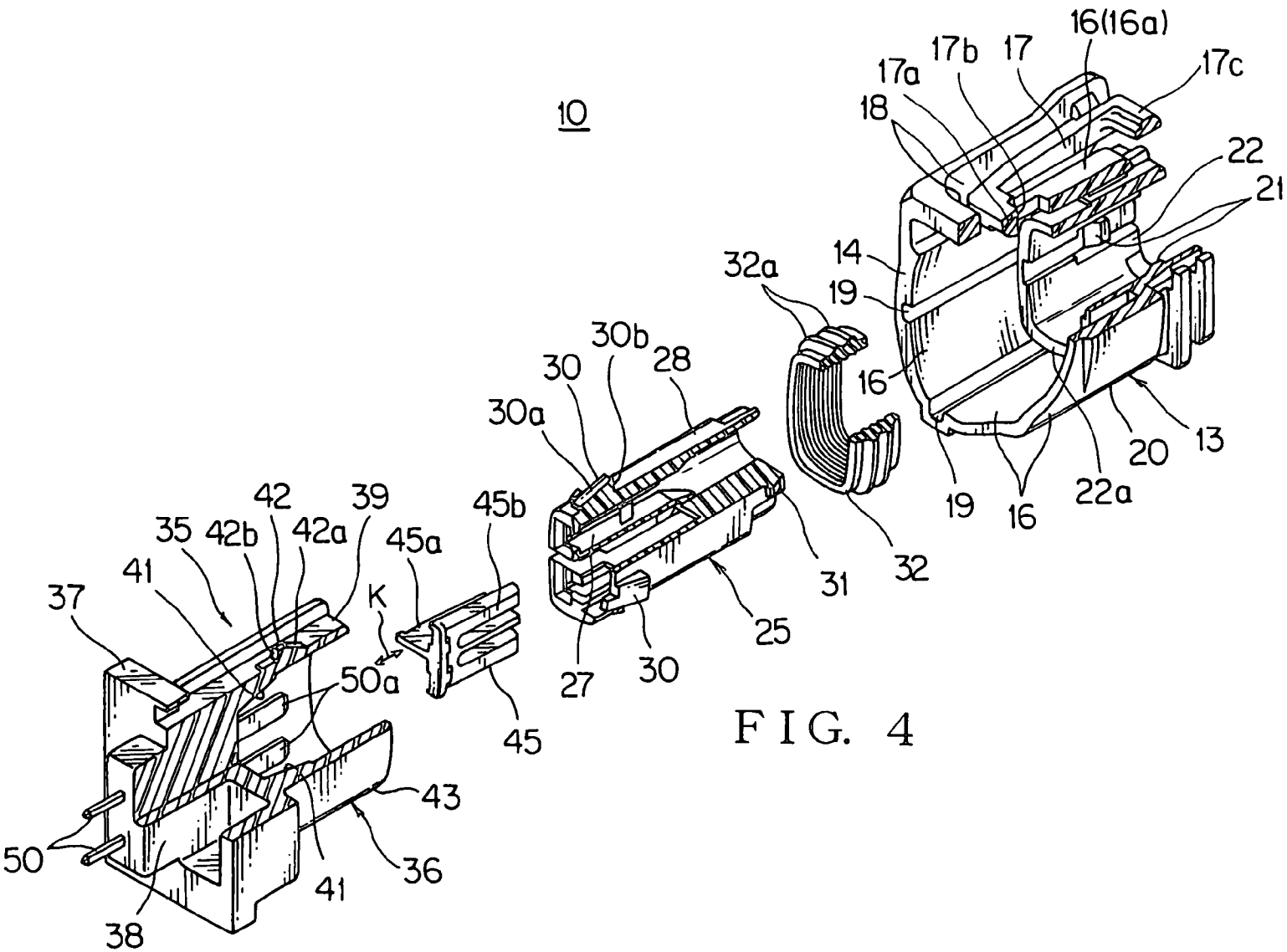
FIG. 4 is an exploded perspective view showing the connector.

10 vibration resisting connector (connector)
13 male connector housing (second connector housing)
25 inner housing
28 peripheral wall
30 looseness prohibiting projection
30*a* tapered surface
32 waterproof packing (resilient member)
36 female connector housing (first connector housing)
39 peripheral wall
41 tapered surface

BEST MODE EMBODYING THE PRESENT INVENTION

Referring to the accompanied drawings, an embodiments of the present invention will be discussed in detail. FIGS. 1 to 4 show an embodiment of an electrical connector according to the present invention.

A vibration-resisting connector 10 is, for example, one of electrical connection parts used in an automotive vehicle. The vehicle induces vibration of electric equipment or the electric equipment itself excite vibration. The vibration-resisting connector 10 intends to reduce looseness between connector housings to improve electrical connection of male and female terminals accommodated in the connector housings against vibration of the vehicle during running, engine oriented vibrations, or self-oscillation of the electrical equipment.

The vibration-resisting connector 10 according to the present invention has a comparatively small number of parts, The vibration-resisting connector 10 has connector housings 13, 36 which are reduced in looseness between the connector housings in a mating direction K and a lateral direction to the mating direction, so that frictional wear of male and female terminals 48, 50 will be surely prevented. The vibration-resisting connector 10 provides a reliable resistance to external vibrations. The male connector housing (second connector housing) 13 has an inner housing 25. The inner housing 25 is resiliently supported by a waterproof packing 32 of made of a resilient member in the mating direction K. The inner housing 25 has a plurality of looseness prohibiting projections 30 each provided with the tapered surface 30*a*. Meanwhile, the female connector housing (first connector housing) 36 has a peripheral wall 39 of which an inner surface is formed with a tapered surface 41. The tapered surface 41 engages with a tapered surface 30*a* of the looseness prohibiting projection 30 on complete mating of the connector housings 13, 36. The waterproof packing 32 is closely sandwiched between an outer surface of a peripheral wall 28 of the inner housing 25 and an inner surface of a peripheral wall 39 of the female connector housing 36 on complete mating of the connector housings 13, 36.

Next, the vibration-resisting connector 10 will be discussed in primary constitutions and operational effects thereof. As shown in FIG. 1, the vibration-resisting connector 10 has the male connector 12 and a female connector 35, the male connector 12 has a male connector housing 13 accommodating the female terminal 48, and the female connector 35 has the female connector housing 36 accommodating the male terminal 50.

Note that upward, downward, left, right, forward, and rearward directions are defined as follows in this specification descriptions. The upward and downward directions are along a row direction of a plurality of female terminals 48. In an upside, there is a locking arm 17. The left and right directions are along a thickness direction of the male terminal 50 of a tab-shape. The forward and rearward directions are along the mating direction shown by an arrow K of FIG. 1. The forward is defined to be an advancing direction of the connector housings 13, 36 when mated. The mating direction K is an advancing direction of the connector housings 13, 36 when the connector housings come toward each other.

The male connector 12 has the male connector housing 13, a waterproof packing (corresponding to a resilient member) 32, a front holder 45 (FIG. 3) for finally locking terminals, and the female terminal 48 connected to an electrical cable.

The male connector housing 13 has a hood 20 defining an outer housing and an inner housing 25 defining a terminal accommodation chamber. The hood 20 is formed by injection molding from a synthetic resin material. The hood 20 has a fore wall 14 and a plurality of peripheral walls 16 to define a box-shape. The fore wall 14 is positioned nearer the female connector 35 side than the peripheral wall 16. The fore wall 14 has an opening into which the inner housing 25 is inserted.

The plurality of peripheral walls 16 are contiguous with the fore wall 14. The top one 16*a* (FIG. 2) of the peripheral walls 16, which is called as a top wall, is formed with a resilient locking arm 17. The locking arm 17 is like a seesaw. The locking arm 17 has a locking portion 17*a* in a fore side, a pushing portion 17*c* in a rear side, and a supporting base 17*d* in a longitudinal middle. The locking portion 17*a* orients downward. The pushing portion 17*c* serves to release locking. The supporting base 17*d* is connected to the top wall 16*a*. The locking portion 17*a* has a vertical locking face 17*b*. The locking face 17*b* abuts against a vertical locking face 42*b* (FIG. 2) of a locking protrusion 42 formed in the peripheral wall 39 of the female connector housing 36 to lock the connector housings 13, 36 to each other.

From the top wall 16*a*, a protecting wall 18 is raised so as to extend from the fore wall 14. The protecting wall 18 is surrounding the locking arm 17. Therefore, the locking arm 17 is protected against unintentional external forces, preventing undesirable lock releasing of the connector housings 13, 36.

Furthermore, the peripheral walls 16 have plurality of guide grooves 19 (FIG. 4) and define a housing receiving portion 22 for the inner housing 25. The guide grooves 19 are associated with guide ribs (not shown) extended on the peripheral wall 39 of the female connector housing 36 in the embodiment. In the embodiment, the guide grooves 19 are provided in the peripheral walls 16 disposed perpendicular to each other. Thereby, the female connector housing 36 is positioned in upward and downward directions, leftward, and rightward directions, so that the connector housings 13, 36 mates smoothly with each other.

The housing receiving portion 22 is positioned in a distal side of an inner space of the male connector housing 13. The housing receiving portion 22 has a locking projection 21 (FIG. 4) in an inner surface of the peripheral wall 16. The locking projection 21 is associated with a locking projection 31 formed in the peripheral wall 28 of the inner housing 25.

The plurality of peripheral walls 16 defining the hood 20 surround the inner housing 25. An annular clearance is defined between the hood 20 and the inner housing 25, so that the clearance receives the peripheral wall 39 of the female connector housing 36.

The inner housing 25 is made from a synthetic resin material by injection molding and has a generally rectangular section. The inner housing 25 is cylindrical and includes two terminal accomodating chambers 26 separated by a partition. The inner housing 25 has an insertion opening 27 (FIG. 4) for the front holder 45.

The terminal accomodating chamber 26 receives the female terminals 48. The terminal accomodating chamber 26 has a terminal locking lance (not shown). The locking lance has a protrusion abutting against a rear end of an electrical contact 48*a* of the female terminal 48 to preliminarily lock the female terminal 48. The insertion opening 27 is contiguous with the terminal accomodating chamber 26 and with a space for deflection of the terminal locking lance. The insertion of the front holder 45 into the insertion opening 27 prevents the deflection of the terminal locking lance, so that the female terminal 48 is double locked. That is, the insertion opening 27 having received the front holder 45 prevents the female terminal 48 from drawing out from the terminal accomodating chamber 26.

Furthermore, the inner housing 25 has a locking projection 31 projecting from an outer surface of the peripheral wall 28. The locking projection 31 is positioned in a rear end side of the peripheral wall 28, that is, at a distal end from the female connector housing 36. The locking projection 31 engages the locking projection 21. The inner housing 25 having the aforementioned construction is inserted up to the distal end of the housing receiving portion 22 to be attached in the hood 20. Thus, the inner housing 25 is disposed so as to be movable along the mating direction K. The engagement of the locking projection 21 with the locking projection 31 prevents the inner housing 25 from drawing out forward from the hood 20 along the mating direction K (or from moving toward the female connector housing 36).

Furthermore, the inner housing 25 has a plurality of looseness prohibiting projections 30 each having a tapered surface 30*a* projecting from an outer surface of the peripheral wall 28. The plurality of looseness prohibiting projections 30 are positioned in a forward side end of the peripheral walls 28, that is, in the side of the female connector housing 36. The plurality of looseness prohibiting projections 30 are spaced from each other in a circumferential direction of the peripheral wall 28 of the inner housing 25.

The looseness prohibiting projection 30 has a section of a right triangle. The looseness prohibiting protrusion 30 has a tapered surface 30*a* positioned in the side of the female connector housing 36 and a vertical surface 30*b* at its rear end portion. The tapered surface 30*a* is contiguous with the vertical surface 30*b*. The tapered surface 30*a* is unitarily formed with the inner housing 25. That is, the tapered surface 30*a* is integrally formed with the male connector housing 13. The tapered surface 30*a* is opposed to the female connector housing 36 and is not inclined in a lateral direction to the mating direction K. The tapered surface 30*a* is inclined to the mating direction K.

The tapered surface 30*a* engages with the tapered surface 41 formed in an inner surface of the peripheral wall 39 of the female connector housing 36 on complete mating of the connector housings 13, 36. At this time, the tapered surfaces 30*a*, 41 overlap and closely contact each other. The engagement of the tapered surface 30*a* with the tapered surface 41 means the engagement of the looseness prohibiting protrusion 30 with the tapered surface 41. That is, the engagement of the tapered surface 30*a* with the tapered surface 41 means the engagement of the tapered surface 41 with the male connector housing 13.

The vertical surface 30*b* is a surface opposed to a fore end face 22*a* (FIG. 4) of the housing receiving portion 22. After the attachment of the inner housing 25, the waterproof packing 32 is sandwiched between the vertical surface 30*b* and the fore end face 22*a* with the waterproof packing 32 compressed axially. That is, a rear end surface of the waterproof packing 32 abuts against a fore end face 22*a* of the housing receiving portion 22, while a fore end surface of the waterproof packing 32 abuts against the vertical surface 30*b* of the looseness prohibiting protrusion 30. The projecting height of the looseness prohibiting protrusion 30 is generally the same as the thickness of the waterproof packing 32. Thus, the waterproof packing 32 does not ride over the looseness prohibiting protrusion 30 not to draw out forward.

In the rear side of the inner housing 25, there is formed a cable leading portion 29 extended rearward and contiguous with the terminal accomodating chamber 26. Into the cable leading portion 29, a rubber stopper 47 (FIG. 2) covering a leading cable 46 is inserted to prevent invasion of external water into the terminal accomodating chamber 26.

The inner housing 25 is disposed in the hood 20 so as to be movable along the mating direction K. The inner housing 25 is resiliently urged to be biased toward the male connector housing 36 by the waterproof packing 32 discussed later. This absorbs dimensional errors due to shrinkage after the forming of the connector housings 13, 36 and corrects assembling dimensional errors on the mating of the connector housings 13, 36. Thus, the tapered surfaces 30*a*, 41 of the connector housings 13, 36 always closely contact with each other. Thereby, the connector housings 13, 36 are prevented from looseness in the mating direction K and in a direction perpendicular to the mating direction K, achieving a reliable vibration-resisting performance.

The male connector housing 13 described above is the second connector housing referred in this specification descriptions.

The waterproof packing 32 is a rectangular tube made of a synthetic rubber, an elastomeric resin, or the like. The waterproof packing 32 is sandwiched between a fore end face 22*a* of the housing receiving portion 22 and the vertical surface 30*b* of the looseness prohibiting protrusion 30 not to draw out in the longitudinal direction. The abutment of the fore end surface of the waterproof packing 32 against the vertical surface 30*b* of the looseness prohibiting protrusion 30 causes the inner housing 25 to be resiliently biased (supported) by the waterproof packing 32 toward the female connector housing 36.

In outer surface of the waterproof packing 32, two lips 32*a* are formed to closely contact an inner surface of the peripheral wall 39 of the female connector housing 36. The lips 32*a* protrude toward an inner surface of the peripheral wall 39 of the female connector housing 36. The lips 32*a* are pushed by an inner surface of the peripheral wall 39 of the female connector housing 36 into the inner housing 25. Thereby, The waterproof packing 32 fills a clearance between the inner housing 25 and the female connector housing 36 to keep waterproofness therebetween.

The front holder 45 (FIG. 4) has unitarily a horizontal wall 45*a* and a vertical wall 45*b*. The vertical wall 45*b* enters a deflection space of the terminal locking lance to prevent the deflection of the terminal locking lance so that the wall 45*b* locks the female terminal 48 to prevent it from being drawn out. The horizontal wall 45*a* has a locking hole (not shown). The locking hole of the wall 45*a* engages with a protrusion (not shown) formed in an inner wall of the insertion opening 27, so that the front holder 45 is prevented from being drawn out (fallen down).

The female terminal 48 is formed by bending processes from a blank stamped from an electrically conductive plate. The female terminal 48 has an electrical contact 48*a* at one side and a cable crimping contact 48*b* at the other side. The electrical contact 48*a* is a box inserted by a tab 50*a* that is an electrical contact of the male terminal 50 to electrically connect to each other. The cable crimping contact 48*b* has a pair of crimping pieces at each of fore and rear sides. The pieces crimp cable cores and covering layers.

The female connector 35 is directly fitted to an instrument and has the female connector housing 36 and the male terminal 50. The female connector housing 36 has a flange 37 secured to the instrument like an electric motor, a terminal securing portion 38 unitarily formed with the male terminal 50, and a circumferential portion 43 contiguous with the terminal securing portion 38.

The terminal securing portion 38 is square and has the male terminals 50 embedded therein. The flange 37 projects from an outer surface of the terminal securing portion 38. The circumferential portion 43 has a plurality of peripheral walls 39. Each peripheral wall 39 is extended from a periphery of the terminal securing portion 38 toward the male connector housing 13.

The peripheral wall 39 defines the connector housing mating space 40 therein to receive the inner housing 25. In the connector housing mating space 40, a tab 50*a* of the male terminal 50 is extended. In the connector housing mating space 40, the male and female terminals 48,50 connect to each other on mating the connector housings 13, 36.

The tapered surface 41 is defined between a rear end of the connector housing mating space 40 and an inner surface of the peripheral wall 39. The tapered surface 41 is unitarily formed with female connector housing 36. The tapered surface 41 engages with the tapered surface 30*a* of the looseness prohibiting projection 30. The tapered surface 41 is uniformly inclined in the mating direction K the same as the tapered surface 30*a*. The tapered surface 41 is inclined but defines a flat surface along the inclined direction.

The tapered surface 41 is generally opposed to the male connector housing 13 and inclined relative to the mating direction K. The tapered surfaces 30*a*, 41 engage or closely overlap with each other on complete mating of the connector housings 13, 36. That is, the tapered surfaces 30*a*, 41 engage with each other in surface-contact state to prevent looseness of the inner housing 25 and the female connector housing 36 in the mating direction and in a direction perpendicular to the mating direction on complete mating of the connector housings 13, 36.

Furthermore, on the top one of the peripheral wall 39 of FIG. 1, there is formed a locking protrusion 42 engaging with a locking portion 17*a* of the locking arm 17. The locking protrusion 42 has a tapered surface 42*a* opposed to the male connector housing 13 and a vertical locking face 42*b* contiguous with the tapered surface 42*a*. The engagement of the locking face 42*b* with a locking face 17*b* of the locking portion 17*a* engages the locking protrusion 42 with the locking arm 17, so that the connector housings 13, 36 lock (mate) to each other.

Note that the female connector housing 36 discussed above corresponds to the first connector housing described in the specification descriptions.

The male terminal 50 is a bar made of an electrically conductive metal. The male terminal 50 is partially embedded in the terminal securing portion 38 such that the tab 50*a* defining a contact is positioned in the connector housing mating space 40.

Next, assembling and mating processes of the vibration-resisting connector 10 will be discussed. First, the male connector male connector 12 is assembled as described hereinafter. The waterproof packing 32 is inserted over the inner housing 25 from a rear side of the inner housing 25. Then, the inner housing 25 is inserted into the housing receiving portion 22 of the male connector housing 13. The waterproof packing 32 is sandwiched and compressed between the fore end face 22*a* of the housing receiving portion 22 and the vertical surface 30*b* (FIG. 4) of the looseness prohibiting projection 30. The inner housing 25 is pushed deeply into the male connector 12 against the resilient force of the waterproof packing 32, and the locking projection 31 of the inner housing 25 is engaged with the locking projection 21 of the housing receiving portion 22. Then, the female terminal 48 is inserted into the terminal accomodating chamber 26 of the inner housing 25. Thereafter, the front holder 45 is inserted into the insertion opening 27 of the inner housing 25 to complete the assembling the male connector 12.

Next, the mating process of the vibration-resisting connector 10 is carried out as described hereinafter. The female connector housing 36 is inserted into the male connector housing 13 so that the inner housing 25 is pushed into the connector housing mating space 40 of the female connector housing 36, and the peripheral wall 39 of the female connector housing 36 is inserted into the circumferential space of the male connector housing 13. The connector housings 13, 36 mates further deeply, so that the distal tapered surface 41 of the connector housing mating space 40 engages the tapered surface 30*a* of the looseness prohibiting projection 30 of the inner housing 25, while the inner housing 25 compresses the waterproof packing 32 against the resiliency of the waterproof packing 32. Then, the locking protrusion 42 of the female connector housing 36 engages with the locking portion 17*a* of the locking arm 17 to complete the mating of the connector housings 13, 36.

In the complete mating state of the connector housings 13, 36, the resilient force of the waterproof packing 32 urges the inner housing 25 forward toward the female connector housing 36, so that the tapered surface 30*a* of the looseness prohibiting projection 30 engages closely with the tapered surface 41 of the female connector housing 36. Furthermore, an inner surface of the peripheral wall 28 of the inner housing 25 and an outer surface of the peripheral wall 39 of the female connector housing 36 contact the waterproof packing 32. That is, in the complete mating of the connector housings 13, 36, the waterproof packing 32 is closely sandwiched between the inner surface of the peripheral wall 28 of the inner housing 25 and the outer surface of the peripheral wall 39 of the female connector housing 36.

The embodiment prevents the looseness of the connector housings 13, 36 in the mating direction K and a direction perpendicular to the mating direction K and surely prevents frictional wear (fretting wear) of the male and female terminals 48, 50 of the connector housings 13, 36. The inner housing 25 is movably supported along the mating direction and resiliently urged toward the female connector housing 36. Thereby, the tapered surface 30*a* of the inner housing 25 closely contacts the tapered surface 41 of the female connector housing 36 to achieve a reliable vibration-resisting function, further surely preventing loosening of the connector housings 13, 36 and also preventing frictional wear of the male and female terminals 48, 50.

The tapered surfaces 30*a*, 41 are inclined in the mating direction K, so that the tapered surfaces 30*a*, 41 can resist against crash or frictional wear more than protrusions on an inner or outer surface of the connector housings 13, 36. Accordingly, even with aged deterioration, the tapered surfaces 30*a*, 41 continue to closely contact with each other, so that the connector housings 13, 36 mate with each other and are prevented from vibration relative to each other, allowing a reliable resistance to vibrations.

The tapered surfaces 30*a*, 41 each are unitarily formed with each of the connector housings 13, 36, so that no additional parts are increased. Relative positions of the tapered surfaces 30*a*, 41 to the connector housings 13, 36 and relative positions of the tapered surfaces 30*a*, 41 to each other are kept constant. That is, relative positions of the tapered surfaces 30*a*, 41 to the male connector housing 13 and relative positions of the tapered surfaces 30*a*, 41 to the female connector housing 36 are kept constant.

Thus, the tapered surfaces 30*a*, 41 can engage each other in the constant condition. The tapered surface 30*a* can always engage the female connector housing 36 in the constant condition, while the tapered surface 41 can always engage the male connector housing 13 in a constant condition. Accordingly, the connector housings 13, 36 always contact each other reliably, preventing the connector housings 13, 36 from vibration relative to each other, always providing a reliable vibration-resistant performance.

Note that the present invention is not limited in the discussed embodiments but may be embodied and modified within the spirit of the invention as described hereinafter.

(1) Circumferentially continuous looseness prohibiting members may be provided instead of the plurality of the looseness prohibiting projections 30 formed in the peripheral wall 28 of the inner housing 25. The looseness prohibiting members may be configured as various shapes such as a rib, step, etc. The circumferentially continuous tapered surface of the looseness prohibiting member increases contact areas between the tapered surfaces of the connector housings 13, 36, improving a resisting performance of the vibration-resisting connector 10. The circumferential tapered surfaces correct an alignment error of the male and female terminals 48, 50, so that male and female terminals 48, 50 smoothly connect to each other, improving terminal connection in reliability.

(2) The female connector 35 may be an ordinary wiring harness connector in place of the connector directly coupled to an instrument. This expands applications of the vibration-resisting connector 10.

(3) The waterproof packing 32 may be unitarily formed with the inner housing 25 instead of the waterproof packing 32 separately formed from the inner housing 25. This unitary configuration decreases the number of constitutional parts and minimizes accumulated dimensional errors, improving the vibration-resisting performance.

(4) A large clearance may be provided between the fore end face 22*a* of the housing receiving portion 22 and the vertical surface 30*b* of the looseness prohibiting projection 30. Thereby, between the fore end face 22*a* and the vertical surface 30*b*, the waterproof packing 32 is not compressed when the male connector 12 is assembled. On the complete mating of connector housings 13, 36, the inner housing 25 is pushed inward so that the waterproof packing 32 is compressed and pinched between the fore end face 22*a* and the vertical surface 30*b*. The resilient force of the waterproof packing 32 urges forward the inner housing 25. This closely contacts the tapered surface 30*a* of the looseness prohibiting projection 30 with the tapered surface 41 of the female connector housing 36 and also easily inserts the inner housing 25 into the male connector housing 13, improving workability in assembling of the male connector 12.

Figure 5:
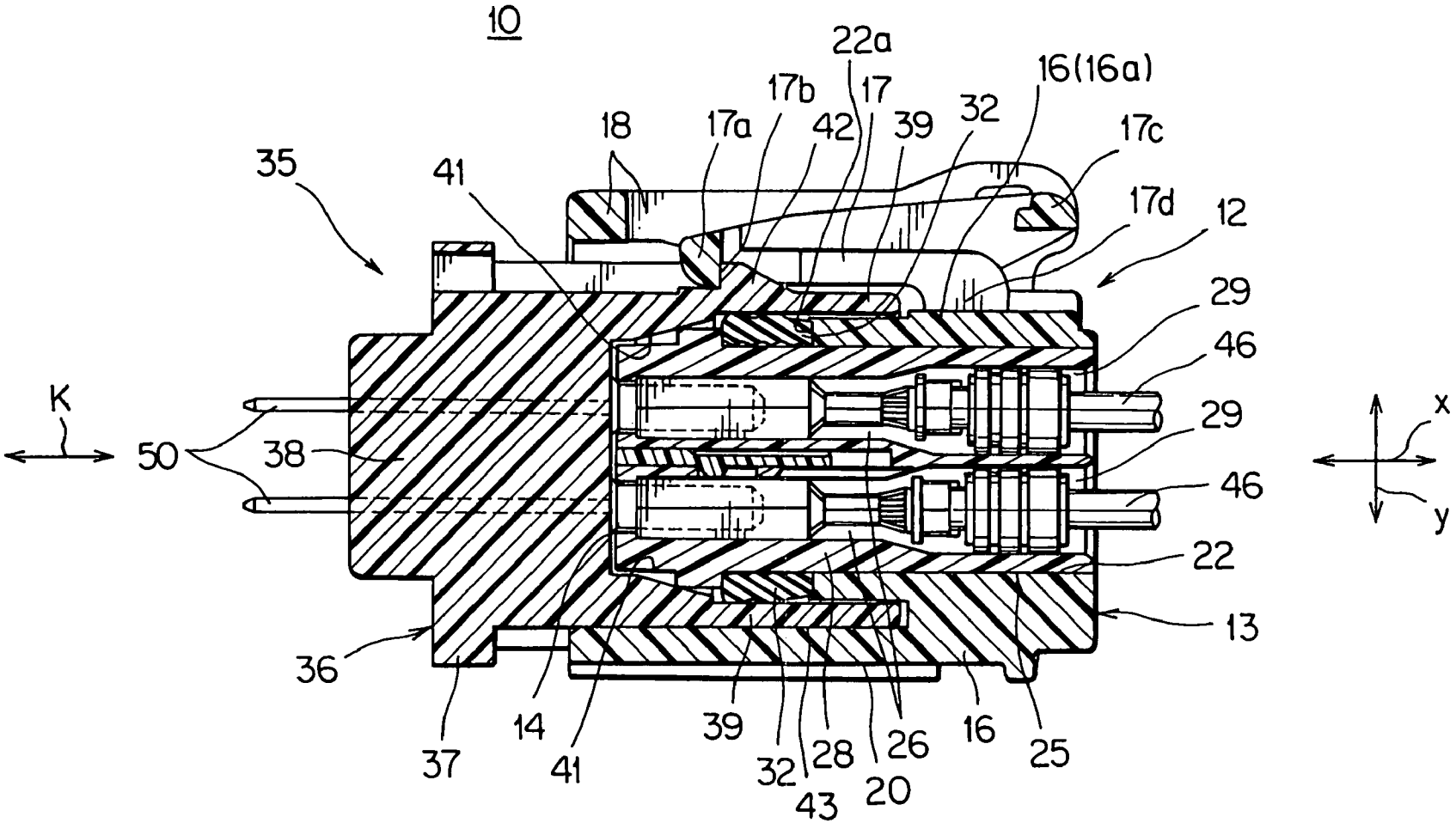
FIG. 5 is a sectional view showing a modified example of the connector of FIG. 1.

(6) As shown in FIG. 5, the tapered surface 41 may be provided in the female connector housing 36 and the tapered surface 41 may abut against the male connector housing 13 in place of the tapered surface 30*a* of the male connector housing 13.

Figure 6:
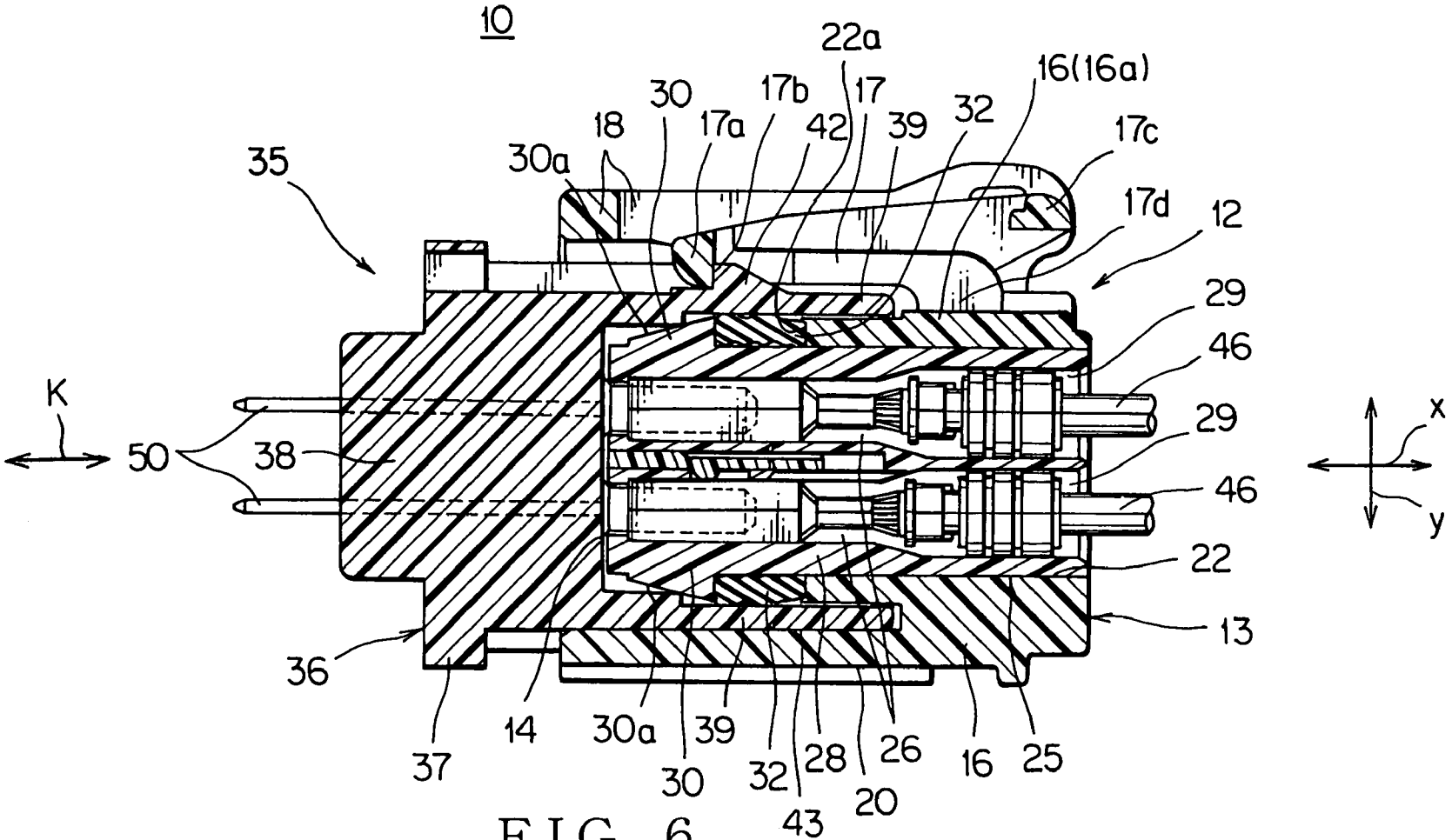
FIG. 6 is a sectional view showing another modified example of the connector of FIG. 1.
Figure 7:
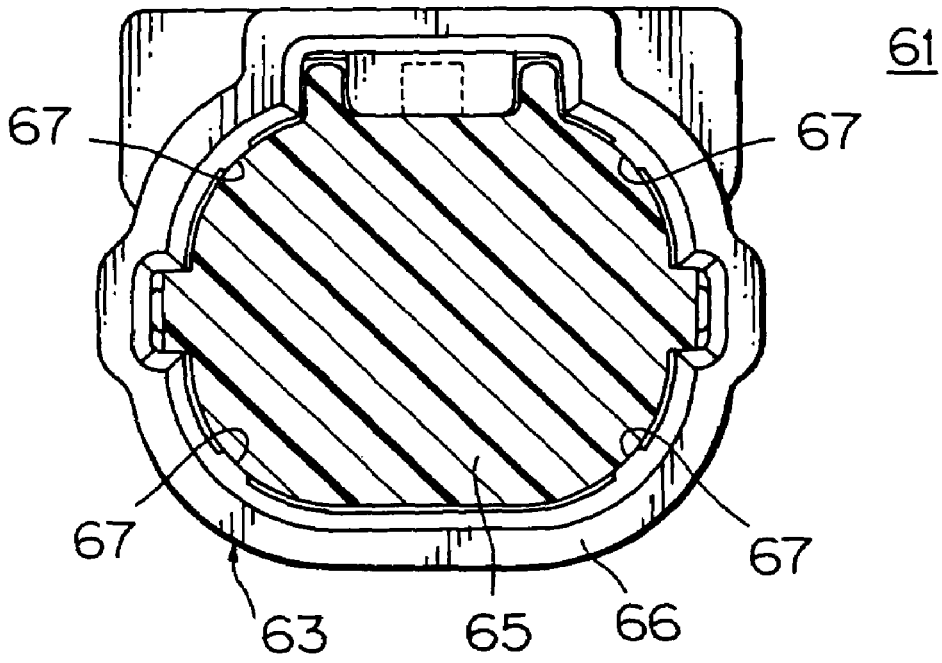
PRIOR ART FIG. 7
FIG. 7 is a sectional view showing a mating state of a conventional electrical connector.
Figure 8:
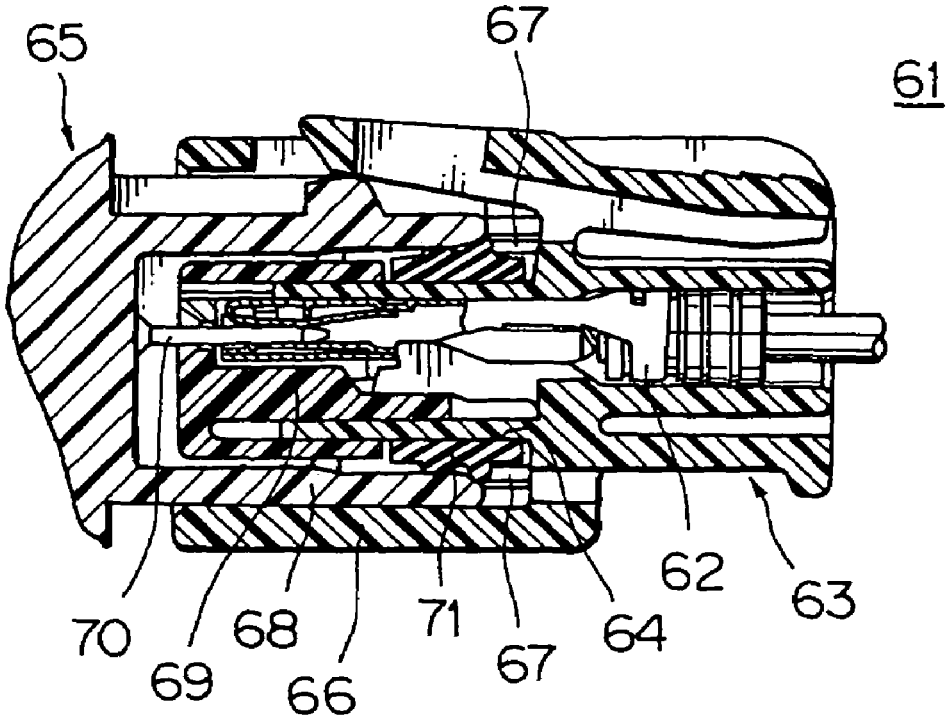
PRIOR ART FIG. 8
FIG. 8 is a longitudinal sectional view showing a state of the conventional connector of FIG. 7 just before mating of its housings.

(7) As shown in FIG. 6, the tapered surface 30*a* may be provided in the male connector housing 13 and the tapered surface 30*a* may abut against the female connector housing 36 in place of the tapered surface 41 of the female connector housing 36. As shown in FIGS. 5, 6, these configurations reduce vibration of the connector housings 13, 36 relative to each other and also minimize frictional wear between the male and female terminals 48, 50. In FIGS. 5, 6, since the same reference numerals are provided for the same parts as the aforementioned embodiments, discussions thereof will not be repeated.

(8) The tapered surfaces 30*a*, 41 may be provided as parts separated from the connector housings 13, 36. That is, the tapered surfaces 30*a*, 41 may be separately formed from the connector housings 13, 36.

(9) The inner housing 25 may be unitarily formed with the hood 20.

The invention claimed is:

1. An electrical connector comprising:

a first female connector housing and a second male connector housing mating with the first female connector housing, the first female connector housing having a male connector housing mating space wit a first peripheral wall, and a tapered surface formed on an inner surface of the first peripheral wall, the second male connector housing having an inner housing with a second peripheral wall, and a tapered surface projecting from an outer surface and positioned at a forward end of the second peripheral wall, wherein each tapered surface is integrally formed on the first and second connector housings, the tapered surfaces inclined in the mating direction of the first and second connector housings, the tapered surfaces engaging with each other on complete mating of the first and second connector housings.

2. The electrical connector according to claim 1 characterized in that each tapered surface is unitarily formed with each of the connector housings.

* * * * *